United States Patent [19]

Oldweiler

[11] Patent Number: 4,614,229

[45] Date of Patent: Sep. 30, 1986

[54] METHOD AND APPARATUS FOR EFFICIENT RECOVERY OF HEAT FROM HOT GASES THAT TEND TO FOUL HEAT EXCHANGER TUBES

[75] Inventor: Morey E. Oldweiler, Chester, N.J.

[73] Assignee: Exxon Research & Engineering Co., Florham Park, N.J.

[21] Appl. No.: 506,036

[22] Filed: Jun. 20, 1983

[51] Int. Cl.[4] ..... F28D 3/04

[52] U.S. Cl. ..... 165/115; 165/118; 208/48 R; 261/153

[58] Field of Search ..... 165/115, 118; 208/48 R, 208/48 Q; 585/648, 650, 950; 261/153

[56] References Cited

U.S. PATENT DOCUMENTS

| | | | |
|---|---|---|---|
| 3,274,752 | 9/1966 | Huyghe et al. | 261/153 X |
| 3,357,485 | 12/1967 | O'Sullivan et al. | 165/174 |
| 3,364,982 | 1/1968 | Jaffe | 165/115 X |
| 3,392,211 | 7/1968 | Buschmann et al. | 585/650 |
| 3,400,754 | 9/1968 | Barbu et al. | 165/134 R X |
| 3,574,781 | 4/1971 | Racine et al. | 260/683 |
| 3,593,968 | 7/1971 | Geddes | 261/118 |
| 3,641,190 | 2/1972 | Kivlen et al. | 260/683 |
| 3,827,481 | 8/1974 | Mandy et al. | 165/118 |
| 3,907,661 | 9/1975 | Gwyn et al. | 206/48 |
| 3,959,420 | 5/1976 | Geddes et al. | 261/112 |
| 4,097,544 | 6/1978 | Hengstebeck | 260/683 |
| 4,105,540 | 8/1978 | Weinland | 585/950 X |
| 4,121,908 | 10/1978 | Raab et al. | 422/207 |
| 4,233,137 | 11/1980 | Ozaki et al. | 208/48 |
| 4,252,752 | 2/1981 | Flandroy | 261/153 |
| 4,268,375 | 5/1981 | Johnson et al. | 208/48 Q X |
| 4,435,339 | 3/1984 | Kragh | 261/153 |
| 4,457,364 | 7/1984 | DiNicolantonio et al. | 165/134 R |

FOREIGN PATENT DOCUMENTS

| | | | |
|---|---|---|---|
| 662537 | 6/1938 | Fed. Rep. of Germany | 165/115 |
| 583938 | 1/1925 | France | 165/118 |
| 0001747 | 1/1977 | Japan | 165/174 |
| 1077918 | 11/1965 | United Kingdom . | |

*Primary Examiner*—Albert W. Davis, Jr.
*Assistant Examiner*—Randolph A. Smith
*Attorney, Agent, or Firm*—R. Yablonsky; F. A. Sinnock

[57] ABSTRACT

A method, together with suitable apparatus therefor, is provided useful in recovering heat from a high temperature cracked hydrocarbon gas, in which a liquid wash is injected into the tubes of a vertically oriented multitube transfer line heat exchanger to minimize deposition of coke. The wash liquid is introduced into a plenum chamber located above the top tube sheet and it then flows through a perforated plate. This distributes the liquid uniformly over the plate where it flows into the tubes to dissolve and/or flux condensates and coke.

11 Claims, 6 Drawing Figures

METHOD AND APPARATUS FOR EFFICIENT RECOVERY OF HEAT FROM HOT GASES THAT TEND TO FOUL HEAT EXCHANGER TUBES

FIELD OF THE INVENTION

This invention relates to a method and apparatus for recovering heat from high temperature thermally cracked hydrocarbons in gaseous form and more particularly to a transfer line heat exchanger of multitube construction in which efficient distribution of liquid wash to the inner surfaces of the tubes is achieved, for the purpose of minimizing fouling problems.

BACKGROUND OF THE INVENTION

Thermal cracking of hydrocarbons may be carried out in the presence of steam. Steam cracking is a well-known process and is described in U.S. Pat. No. 3,641,190 and British Patent No. 1,077,918, the teachings of which are hereby incorporated by reference. In commercial practice, steam cracking is carried out by passing a hydrocarbon feed mixed with 20–95 mol. % steam through metal pyrolysis tubes located in a fuel fired furnace to raise the feed to cracking temperatures, e.g., about 1400° to 1700° F. and to supply the endothermic heat of reaction, for the production of products including unsaturated light hydrocarbons, particularly $C_2$–$C_4$ olefins and diolefins, especially ethylene, useful as chemicals and chemical intermediates.

The cracked effluent may be cooled in a transfer line exchanger (TLE). That name has been used to designate a heat exchanger, connected in a transfer line between the furnace and fractionator, that is located as close as possible to the outlet of the cracking furnace in order to minimize the time that the product gas is at a high temperature beyond the outlet of the cracking furnace, so as to reduce coking and yield degradation. It may also be noted that two TLE's may be used in series in a transfer line. One may then distinguish between a primary (1° ) TLE and a secondary (2° ) TLE. When these terms are used, the former designates a TLE which is connected to the outlet of the cracking furnace and the latter designates a TLE which is downstream of the primary TLE and cools the cracked gas to a still lower temperature. Conventionally, the cracked gas from many reaction tubes is manifolded, passed into a cone-shaped passage, sometimes referred to as a transition piece or section, thence through a tube sheet and into the cooling tubes of a multitube shell-and-tube TLE in order to cool the gas and generate steam—see U.S. Pat. No. 3,574,781. U.S. Pat. No. 4,097,544 additionally describes a shield forming with the entrance tube sheet of a shell-and-tube TLE a chamber adapted to receive low temperature steam and release the same to mix with incoming cracked gas as a direct prequench, the shield having a conical shape for the purpose of reducing recirculation of gas and thus residence time. See also U.S. Pat. No. 3,357,485 which describes a similarly shaped device for a multitube double-pipe TLE.

When residence time and hydrocarbon partial pressure of the process gas are decreased and cracking is carried out at higher radiant coil outlet temperature, the selectivity to desirable olefins is improved. It is highly desirable to reduce pressure build-up across the exchanger and loss of heat transfer, viz., by preventing heavy components in the cracked gas from condensing and sticking to the inside wall of the tubes thereby restricting flow and impeding heat transfer. From a process point of view, not only the unfired high temperature residence time needs to be minimized, but also the pressure drop in the transfer line and TLE outside of the fire box must be reduced to improve the selectivity, because large pressure drops resulting in increased pressure and increased hydrocarbon partial pressure in the upstream pyrolysis tubes connected thereto, which adversely affects the pyrolysis reaction.

The present invention teaches to reduce pressure loss in the gas when operating in the liquid washed TLE mode.

Upon cooling the effluent from a steam cracker furnace, in particular one cracking a gas oil feed, in an exchanger, the higher boiling components condense on the tube walls and foul the exchanger. The heavier components in the cracked gas condense and because they are viscous and reactive they tend to stick to the wall and polymerize. This deposit grows and can seriously restrict exchanger tubes causing a drastic increase in the exchanger pressure drop as well as impeding heat transfer.

To overcome this problem, the use has been suggested of a recycle wash stream which flows down the inside wall of the exchanger tube and acts as a solvent for the components that condense. In order to be effective, the wash liquid must flow through each tube. To accomplish this U.S. Pat. No. 4,233,137 proposes that the wash liquid be sprayed into the vapor stream entering the exchanger so as to quench the gas. The cooled vapor-liquid mixture then flows through a grid distributor which distributes the liquid to the tubes in the exchanger. A uniform distribution of the liquid to the tubes is difficult to achieve with only a spray system so that it was necessary to provide an orifice distributor at the inlet of the exchanger to help dispense the liquid evenly to the tubes. To be effective, this distributor has to take a pressure drop in the gas of more than 1 psi. This is clearly a disadvantage because it causes higher pressures upstream of the exchanger which reduces cracking selectivity. The subject invention describes an improved way of introducing tne liquid wash to the exchanger that does not have the disadvantage of excessive heating of the wash liquid in the quench operation (which causes degradation of the wash liquid) and eliminates effluent pressure drop due to such distributor as well as due to acceleration of the wash liquid when it is injected as a spray.

U.S. Pat. No. 3,959,420 describes an apparatus for direct quench of pyrolysis gases issuing from a pyrolysis furnace in which oil is caused to overflow from a reservoir so as to coat the inner wall of a quench pipe with a film to prevent fouling. However, with the different configuration of a single quench pipe, the patent does not provide any suggestion applicable to the problem faced in liquid washing of the tubes of a multitube shell-and-tube TLE which may have hundreds of tubes. See also U.S. Pat. Nos. 3,907,661; 4,121,908 and 3,593,968.

SUMMARY OF THE INVENTION

According to the invention a method, together with suitable apparatus therefor, is provided useful in recovering heat from a high temperature cracked hydrocarbon gas, in which a liquid wash is caused to flow uniformly into the tubes of a vertically oriented multitube transfer line heat exchanger where it absorbs viscous high boiling components that condense out of the gas as it cools and any coke particles in the gas. The system is downflow. In general, the wash liquid is introduced into the unit at a location as close as possible to the openings of the exchanger tubes so that the effluent gas is substantially not pre-cooled. Several mechanical configurations can be devised to accomplish this. In a preferred configuration, the wash liquid is introduced into a plenum atop the top tube sheet and it then flows through a distributor, viz., an upper perforated plate. This distributes the liquid uniformly over the upper surface of the plate where it flows into the tubes, contacts the gas, and absorbs condensables and coke particles. Specifically, the method comprises introducing the liquid wash through suitable inlets into a plenum chamber integral with the exchanger and formed by means of the top tube sheet and a distributor plate thereabove, an extension of the tubes from the top tube sheet to the distributor plate, and a cylindrical extension of the gas inlet. The liquid wash is caused to overflow the plenum chamber through holes in the distributor plate and flow downwardly within the tubes, the distributor plate being formed to permit substantially uniform dispensing of the liquid wash to the tubes, viz., it is suitably horizontal.

Another device involves a pipe distributor for the wash liquid located above the tube inlet. The pipes are formed with holes in the bottom through which the liquid will pass and drop into the exchanger tubes. Another device is similar to the preferred configuration just described but instead of having holes in the top distributor plate there are holes in the side of the tubes through which the wash liquid will flow from the plenum chamber into the tubes. These and similar variations or combinations are not precluded in this invention.

The liquid washed TLE of this invention can be applied on a steam cracker furnace effluent in a number of ways including the following:

As a primary TLE without any prior cooling of the furnace outlet effluent; in this case feed to the TLE will be at a temperature in the range of about 1400° to 1600° F.

As a secondary TLE after the effluent has been cooled in a non-liquid washed TLE—for example one generating steam and providing 1500 psig steam—to a temperature in the range of about 700°–1300° F.

Preferably as a secondary TLE after a non-liquid washed steam superheating primary TLE which cools the effluent gas to a temperature in the range of about 1100° to 1300° F.

The liquid washed TLE is advantageously used as a secondary TLE in conjunction with a non-liquid washed primary TLE of a configuration permitting close coupling to the outlet of the cracking furnace.

The liquid wash is a high boiling range hydrocarbon material which will remain to a substantial extent in liquid form under the conditions of use, is generally of a tarry nature and consists in greater part of the liquid which is condensed in the TLE and is separated from the exiting gas in a vapor/liquid separator.

The liquid washed TLE may be employed to generate steam or to preheat the cracking feed or air for burning fuel in the furnace. It may be used in connection with the thermal cracking of a variety of feeds such as gases, e.g., ethane, propane, and naphtha, but the greatest incentive for use is in the cracking of gas oil feeds, e.g., atmospheric or vacuum gas oils, in view of the well-known correlation that heavier feedstocks produce more highly viscous condensable hydrocarbons than light feedstocks and thus will benefit most from a liquid wash. Additionally, it may be used on the gaseous effluent of other thermal conversion processes of hydrocarbons in which a gaseous effluent has a tendency to deposit a foulant on the heat transfer surface during cooling.

BRIEF DESCRIPTION OF THE DRAWINGS

Like parts are designated by like numerals throughout.

DETAILED DESCRIPTION OF THE INVENTION

Figure 1A:
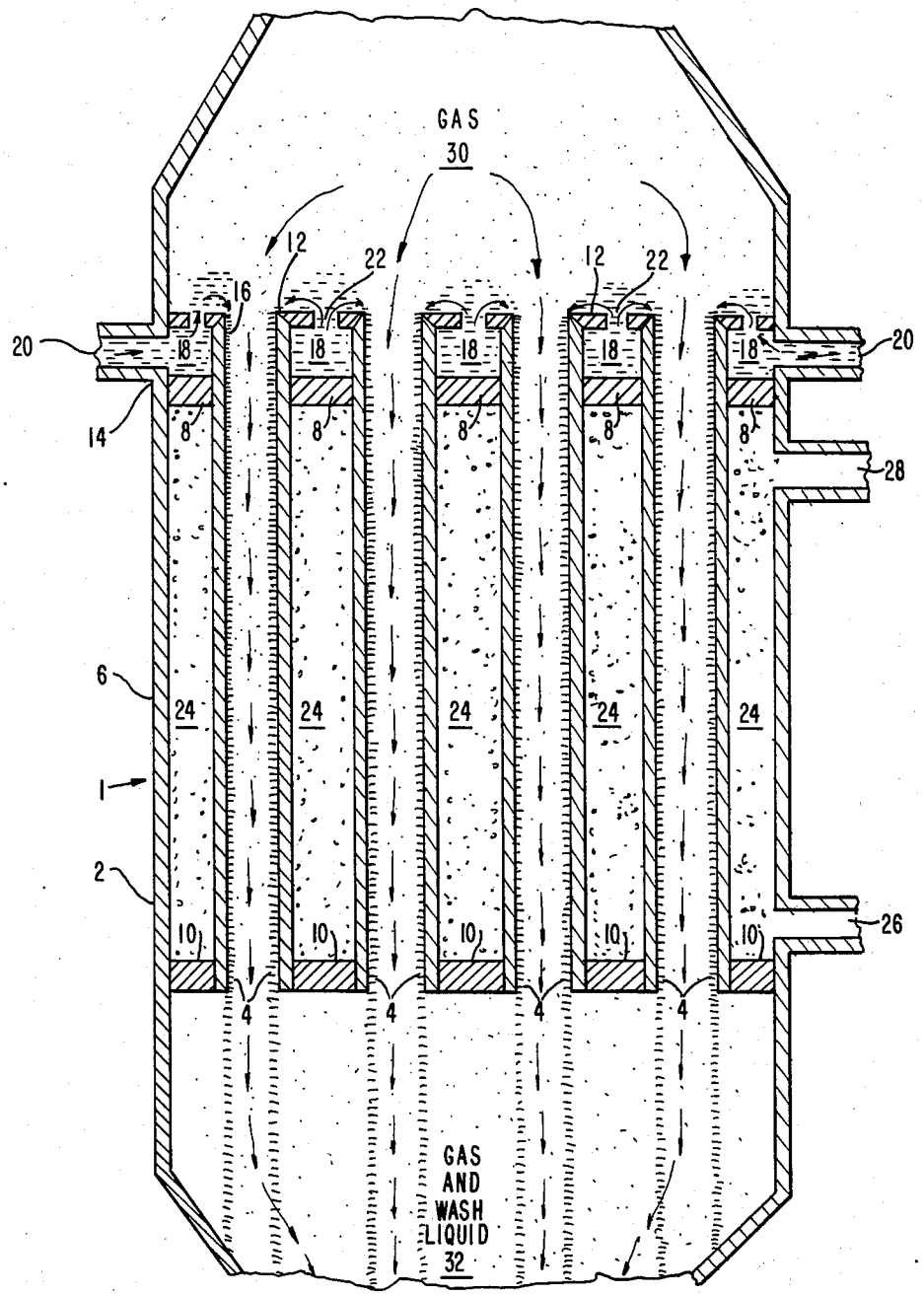
FIG. 1A is a vertical sectional view of a liquid washed multitube shell-and-tube TLE according to the invention and FIG. 2A shows a detailed head section thereof.

As illustrated in FIG. 1A, the TLE 1 comprises a vertical tank having a wall 2 enclosing a multiplicity of tubes 4 of which only four are shown although generally there are hundreds, in an intermediate cylindrical portion 6 of the exchanger. The tubes are supported in the exchanger at the top by top tube sheet 8 and at the bottom by bottom tube sheet 10. A distributor plate 12 is located above the upper tube sheet and the tubes 4 extend through openings, which are in alignment, in the plate and tube sheets. The distributor plate with the top tube sheet, a wall section 14 of the cylindrical portion, which may be a spacer, therebetween and a wall portion 16 of the tubes that extends between said plate and top tube sheet, defines a plenum chamber 18 for the wash liquid. A number of wash liquid inlets 20 to the plenum chamber are provided around section 14. The distributor plate, which is suitably horizontal and suitably parallel to the top tube sheet, contains apertures 22 through which wash liquid in the plenum chamber can flow out. As shown, the plenum chamber is adjacent to and at the top of the shell side 24 of the exchanger in which water is converted to steam by the heat absorbed from the hot cracked gas passed through the tubes 4. Since the distributor plate essentially covers similar areas, viz., the shell side, and is open at similar areas, viz., the tube openings, as the top tube sheet, it follows that wash liquid emerging from the apertures 22 spills over into the tubes 4 and flows down the tubes where it functions to absorb condensables and coke from the gas also passing through the tubes. An inlet 26 for water and an outlet 28 for steam/water are provided in the shell side of the exchanger. A conical entrance 30 for hot cracked gas is at the top of the exchanger and a conical exit 32 for cooled gas and wash liquid is at the bottom.

Figure 2A:
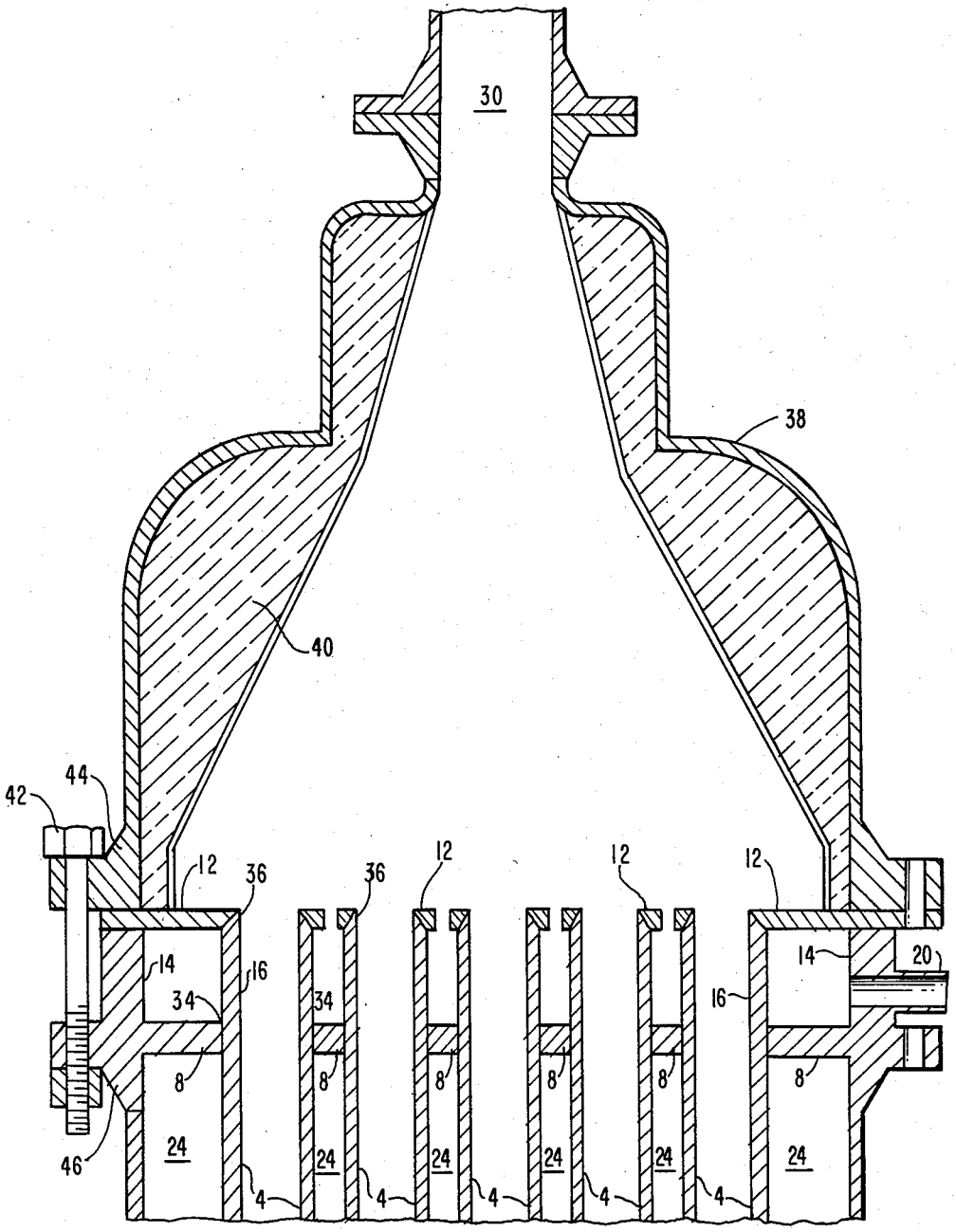

As shown in FIG. 2A, the apparatus can be taken apart if desired. Although the tube sheets are welded to the tubes, as is customary, for example at points 34, the distributor plate 12 is detachable. It has a tight fit over the tubes, for example at points 36, but no weld connections. It is spaced from the top tube sheet 8 by spacer 14 which carries the inlet nozzles for the wash liquid at 20. A hemispherical head 38 surrounds the inlet 30 with insulation 40 therebetween. Bolts 42 passing through an upper flange 44 on the head and a lower flange 46 on the top tube sheet, keep the assembly together.

Figure 3:
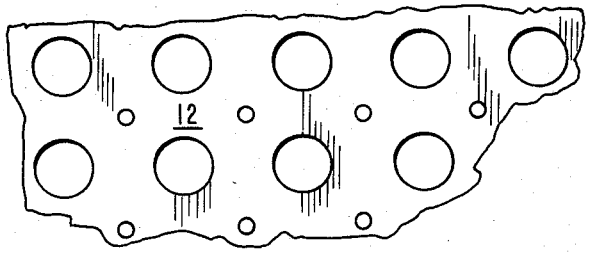
FIG. 3 is a partial top plan view of a distributor plate, broken away.

Since the distributor plate is level, it contributes to uniform distribution of the wash liquid to the tubes inasmuch as the liquid cannot collect in pockets or the like. In general, each distributor hole is associated with a particular tube or a small number of tubes and is adjacent to the opening of the respective tube or tubes. A symmetrical arrangement of distributor holes will also contribute to uniform distribution as shown in FIG. 3 which is illustrative but not limitative of the invention. The arrangement of FIG. 3 exemplifies some of the most desirable features. It has nearly the same number of distributor holes as the number of tubes and both are arranged on a square pattern. In this pattern, each tube would tend to receive 25% of its liquid from each of four holes which are the same distance from the tube. This helps ensure that all tubes will get some liquid even if some of the holes should become plugged with coke. The hole size is not too small, e.g., 0.3 inch, so as not to be prone to plug. The pressure drop of the liquid across the hole may suitably be 0.3 to 0.8 psi which is enough to provide good distribution of the liquid through the holes.

It will be understood that many other designs can be devised within the scope of the invention so that the holes in the distributor plate through which the wash liquid flows and the tubes themselves are arranged to give uniform distribution of liquid to the exchanger tubes.

As indicated, a uniform distribution of the wash liquid to the tubes is highly desirable; a number of measures can be taken to ensure this. This uniform distribution starts with the same rate of liquid flow through each aperture owing to an adequate pressure drop in the liquid across each one. A useful hole diameter size is in the range of about 0.2 to 0.3 inch. The wash liquid may be injected into the plenum chamber 18 between the top tube sheet and the distributor plate at several points around the periphery of the plenum chamber. The pressure drop of the wash liquid when flowing from the wash inlet at the outer rim of the plenum chamber to the holes at the center of the plenum chamber should be small relative to the pressure drop across the holes of the distributor plate.

It may be noted that the pressure drop required to distribute the liquid uniformly to the tubes of the exchanger is taken only on the liquid phase across the orifices in the distributor plate.

Table I illustrates one example of suitable parameters for a liquid washed transfer line exchanger.

TABLE I

| | |
|---|---|
| Surface area, $Ft^2$ | 3040 |
| Number of Tubes | 580 |
| Diameter of Tubes, inches ID | 1.0 |
| Tube layout | Square |
| Tube pitch, inches | 1.70 |
| Length of Tubes, Ft | 20 |
| Tube wall thickness, inches | 0.1 |
| Number of holes in distributor | 580 |
| Diameter of holes in distributor, inches | 0.25 |

In operation, wash liquid suitably at about 500° to 650° F., is pumped through inlets 20 by a pump (not shown) into plenum chamber 18, emerges as a spouting liquid from distributor holes 22 and flows down in tubes 4. The hot cracked gas passes through inlet 30 into the tubes 4 where it is cooled by indirect heat exchange with the water boiling in the shell side 24 of the exchanger. Liquid and process gas flow out of the outlet 32. Steam is thus generated.

Table II gives one example of operating conditions that may be used in a liquid washed transfer line exchanger of this invention.

TABLE II

| | |
|---|---|
| Vapor inlet to TLE, | |
| hydrocarbon lb/hr. | 30,000 |
| steam lb/hr. | 12,000 |
| temperature, °F. | 1300 |
| pressure, psia | 27.2 |
| mol wt. | 38 |
| Inlet wash liquid, | |
| hydrocarbon, lb/hr. | 300,000 |
| temperature, °F. | 550 |
| Total mass rate through tubes, lb/sec-$ft^2$ | 30 |
| Superficial gas velocity in tubes, ft/sec | 55 |
| Exchanger duty, MBTU/hr. | 23.3 |
| Steam Generation Rate, lb/hr. | 28,800 |
| Steam pressure, psia | 620 |
| Boiler feed water temp, °F. | 420 |
| Steam Temp. °F. | 490 |
| Vapor and liquid outlet from TLE | |
| temp, °F. | 550 |
| pressure, psia | 25.6 |
| Pressure drop across tubes, psia | 0.8 |
| Pressure drop in inlet and outlet cones, psia | 0.8 |

An example of a suitable wash liquid is a tar having an initial boiling point of 500° to 700° F., with 20–50% off at 900° F. (atmospheric boiling points) and a density of 1.15 to 1.25 relative to water at 60° F.

The wash liquid essentially does not mix with the gas before it enters the exchanger tubes and the hot cracked gas is essentially not precooled before it reaches the tubes, contrary to the process of U.S. Pat. No. 4,233,137. Once in the tubes, the gas is cooled rapidly by a combination of mixing with the cool liquid and heat transfer to the liquid on the tube wall. The temperature of the wash liquid does not reach as high a temperature as it would have if premixed with the vapor upstream of the tubes.

The liquid passing through the orifices washes the distributor plate of the exchanger and flows into the tubes without coming to temperature equilibrium with the gas. Since it is on the wall of the exchanger tubes, it is close in temperature to the boiling water or feed being heated. This reduces polymerization and deterioration of the wash liquid. It will be noted that the wash liquid flows over the cool surfaces of the distributor plate which prevents condensation of viscous tar on the distributor from the gas.

The liquid does not have to be sprayed into the gas. It is therefore more tolerant of small solid particles which exist in the quench liquid.

The liquid washed TLE can be operated over a wide range of conditions depending on the system in which it is connected, for example as set forth in Table III.

TABLE III

| | |
|---|---|
| Inlet to TLE gas temperature | 700° to 1700° F. |
| Inlet wash oil temperature | 400° to 650° F. |
| Velocity of gas flow in tubes | 40 to 200 ft./sec |
| Total mass rate in tubes | 10 to 50 lb/sec-$ft^2$ |

TABLE III-continued

| | |
|---|---|
| Pressure of steam generated | 100 to 1800 psig |

Figure 4:
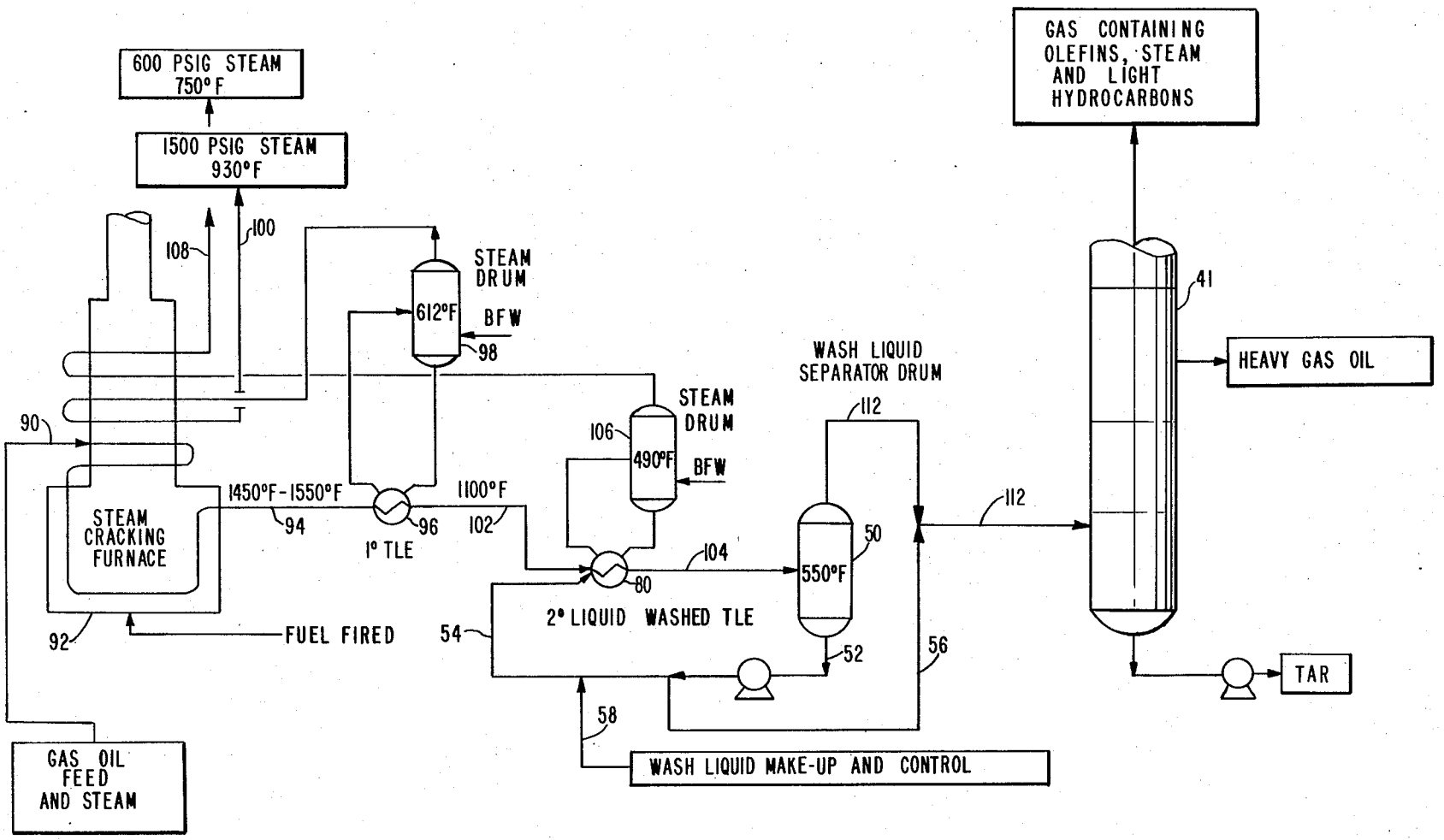
FIG. 4 is a flow plan of one embodiment of the invention in which a non-liquid washed 1° TLE and a 2° liquid washed TLE according to the invention are used in series in a transfer line to generate respectively 1500 psig steam and 600 psig steam.

FIG. 4 shows one sequence of utilizing the liquid washed TLE. Temperatures of the streams are shown by way of example and are not limiting. Gas oil is combined with dilution steam and is passed by line 90 to a fuel fired steam cracking furnace 92 wherein it is converted by thermal cracking to a variety of products including gases, olefins, light hydrocarbon liquid products, a gas oil product, and a tar product. The cracked gas effluent, which may be for example at about 1450°-1550° F. is passed by line 94 to the tubes of the 1° TLE 96, and is cooled in this exchanger to a temperature in the range of about 800°-1150° F., in this example exiting the 1° TLE via line 102 at an average temperature of about 1100° F. Boiler feed water is passed to steam drum 98 where it is preheated, thence to the steam side of TLE 96. Steam is generated, passed to the steam drum and then to the convection section of the furnace and taken off as 1500 psig, 930° F. steam via line 100.

In this service the 1° TLE will foul rapidly when first put on line and then the rate will slow down. The initial temperature of the exiting stream in line 102 may be about 800° F., and the final temperature before decoking may be about 1150° F. It fouls rapidly because the tube wall temperature is 650°-700° F. which causes significant quantities of high boiling viscous components to condense out of the gas and deposit on the tube wall.

Conventional shell-and-tube or double pipe TLE's can be used as the 1° TLE. The rate of fouling can be reduced by using an in-line, close coupled, double pipe TLE of the type disclosed in U.S. Ser. No. 359,197 of A. R. DiNicolantonio et al. filed on Mar. 18, 1982 now U.S. Pat. No. 4,457,364, the teachings of which are incorporated by reference. The particular design minimizes fouling and may be decoked, a minor number of tubes at a time, while the rest remain onstream so that the furnace need not be shut down.

The process gas exiting the 1° TLE by line 102 is passed to the tubes of the liquid washed 2° TLE 80 where it is cooled to about 550° F. in admixture with recycle wash liquid. As the gas is cooled, heavy components condense out of the gas and are absorbed in the wash liquid and thus do not foul the exchanger tubes. Boiler feed water is passed to steam drum 106, where it is preheated, thence to the shell side of the TLE 80. Steam is generated, passed to the steam drum and then to the convection section and taken off as 600 psig, 750° F. steam via line 108.

The gas with liquid exits the 2° TLE 80 via line 104 and flows to drum 50 where the liquid and gas are separated. The gas exits drum 50 via line 112 and flows to the fractionator 41. The wash liquid exits drum 50 via line 52 and a portion is recycled via line 54 to the 2° TLE. The excess liquid is drawn off via line 56 and sent to the fractionator 41. Liquid make-up from the fractionator may be added in minor amounts to the wash liquid as required to reduce its viscosity or reduce its solids content.

The cracked gas furnace effluent passes to fractionator 41 which produces a gas stream containing the olefins, one or more light hydrocarbon streams, a heavy gas oil stream and a tar stream. A portion of the heavy gas oil and tar streams may be used as liquid make-up to the wash liquid via line 58 as previously stated.

In another sequence, a 1° TLE may be used as a steam superheating exchanger with only the 2° liquid washed TLE being used to generate steam. Thus, as shown in FIG. 5, only one pressure of steam is generated.

Figure 5:
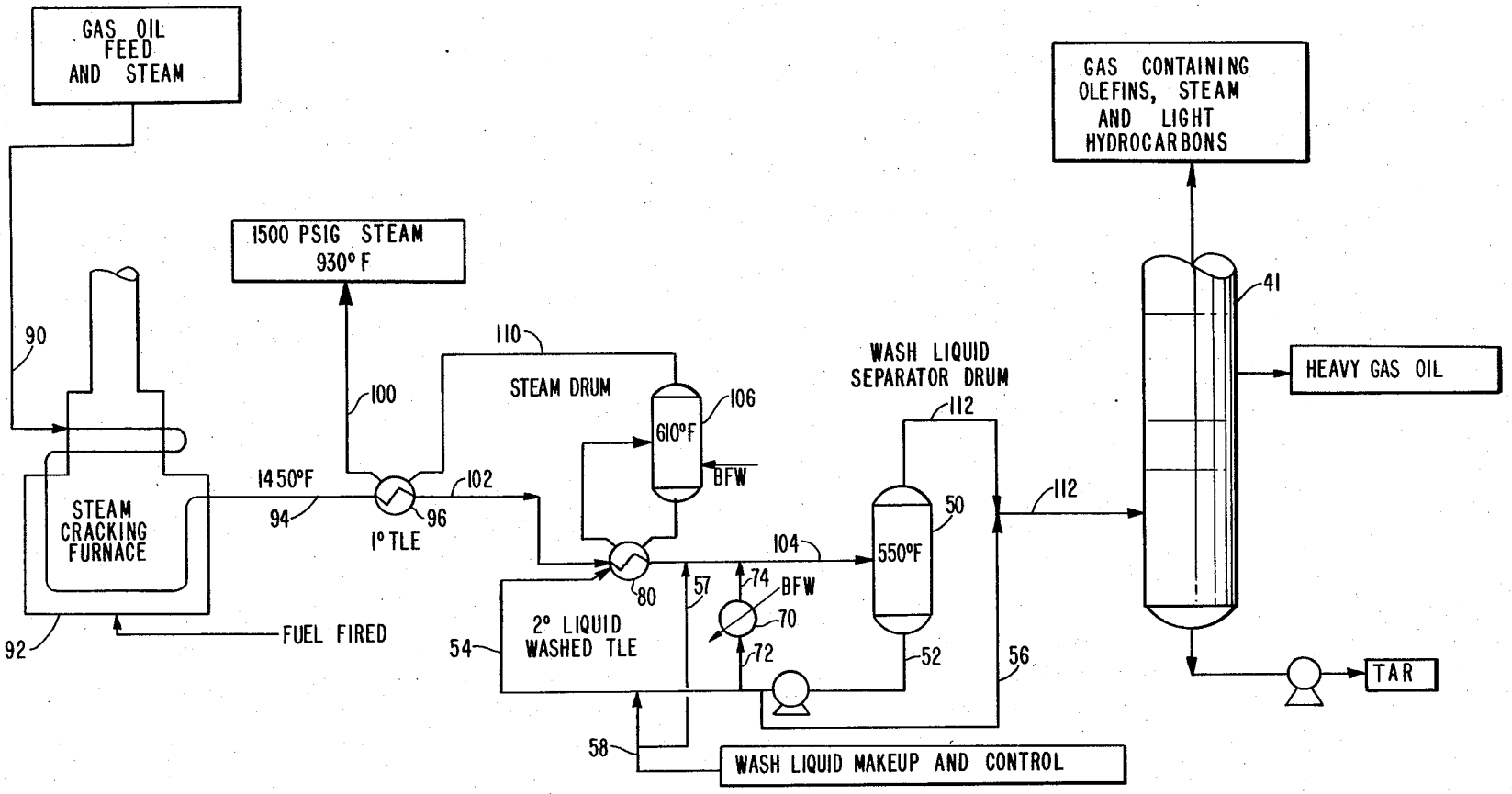
FIG. 5 is a flow plan of a preferred embodiment of the invention in which a 1° non-liquid washed steam superheating TLE and a 2° liquid washed TLE steam generator are used to generate only one pressure of steam, e.g., 1500 psig steam.

Other differences in operation of FIG. 5 over FIG. 4 include: steam is generated in the 2° liquid washed TLE 80 at about 1520 psig and is passed by line 110 to the steam side of the 1° TLE 96 where it is superheated to provide 1500 psig, 930° F. steam. The stream exiting the liquid washed TLE 80 is at a temperature of 650° F. and this may be cooled to about 550° F. by withdrawing a portion of the recycle liquid wash from line 54 via line 72, cooling it in an exchanger 70 and injecting it into line 104 via line 74 and/or by injecting a portion of the wash liquid make-up withdrawn from line 58 into line 104 via line 57. Cooling of stream 104 may be desirable when generating high pressure steam to reduce the viscosity of the wash oil but depending on tar characteristics it may not be necessary in every case.

In this service the 1° TLE will foul very slowly because the tube wall is at a temperature of 950° to 1050° F. which is high enough so that very few high boiling viscous components condense and deposit on the tube wall. The temperature of the wall is high compared to that of a steam generating 1° TLE because the heat transfer coefficient between the steam and the tube wall is much smaller than between boiling water and the tube wall.

It is advantageous to cool the effluent from a gas oil feed steam cracking furnace by superheating 600-1800 psig saturated steam in primary heat exchangers. In such a system, both the primary and secondary exchangers are relatively non-fouling when cooling a gas oil feed effluent. The first exchanger does not foul rapidly because the tube wall is maintained above the condensation temperature of most of the effluent components. The second exchanger does not foul because it is continuously washed with a circulating oil which keeps in solution the high boiling components which condense and which would normally foul an unwashed exchanger.

Other advantages also accrue from this two-stage system. The steam is generated and superheated using only the furnace effluent heat which eliminates steam duty from the convection section and allows cost reductions in this part of the furnace. The amount of heat which is recovered as high level heat (i.e., used to generate steam at 600 psig+pressure) is about doubled over existing TLE systems which can cool the gas to only about 1100° F. when operating on heavy feed. The fouling of existing TLE systems also limits the end points of heavy feeds that can be fed to a steam cracker. Because of its non-fouling performance, this TLE system allows heavier feeds to be processed in the furnace.

The two TLE's together achieve a superior result. The superheating TLE does not have the capability of cooling the product to a low temperature without condensing and fouling (which the liquid washed TLE has); however it can be close coupled to the furnace outlets. By combining the two types of exchangers, a fast quenching and non-fouling system is achieved.

Thus, by combining a steam superheating in-line, close coupled, double pipe primary TLE and a liquid washed secondary TLE steam generator, the fouling problems encountered when operating on heavy feed furnace effluents are eliminated, yield degradation is prevented and the amount of high level heat recovered is increased.

Figure 1B:
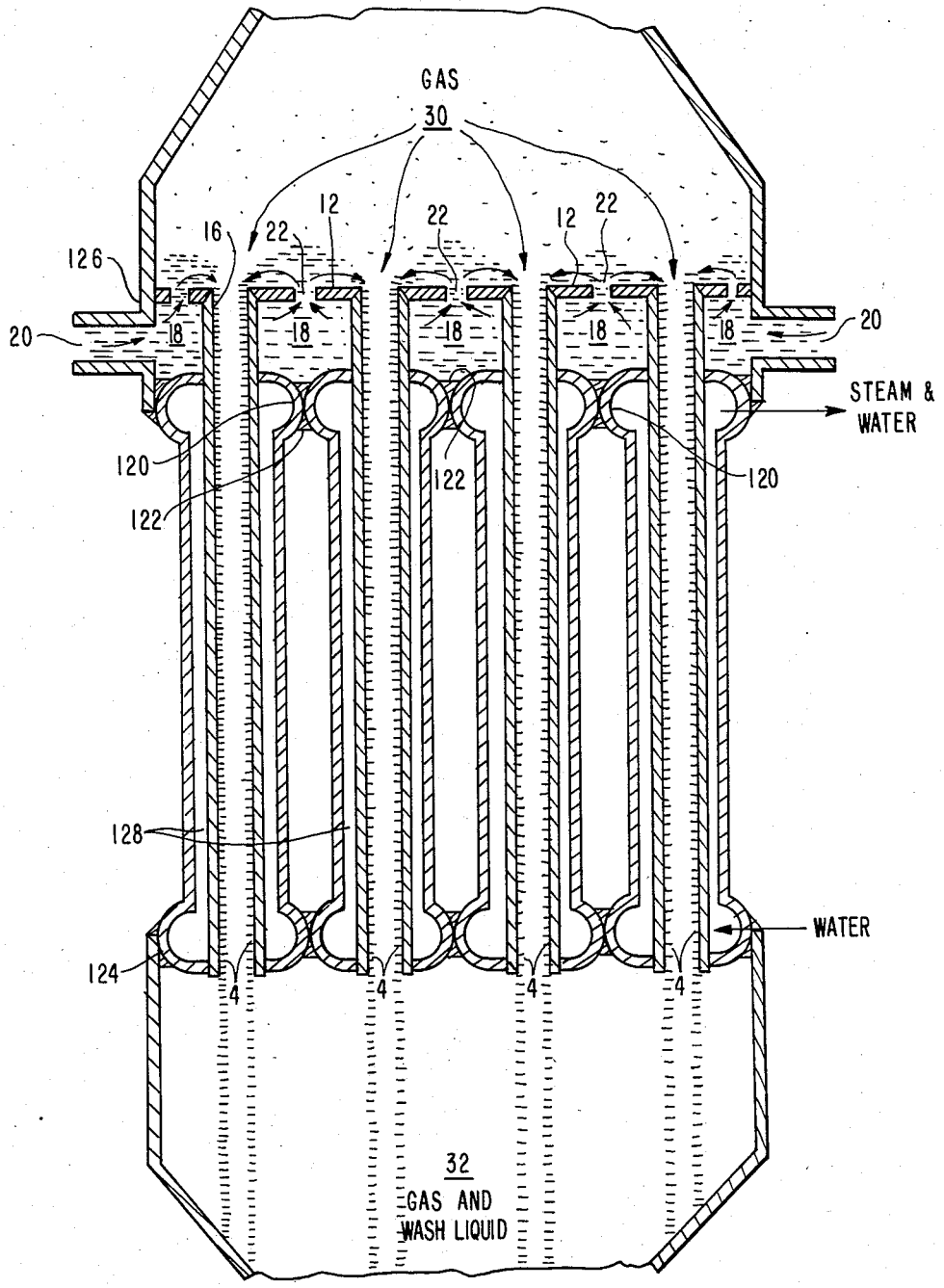
FIG. 1B is a view of a liquid washed multitube double pipe TLE analogous to FIG. 1A.

A variation of the multitube shell-and-tube liquid washed TLE described above is a multitube double pipe liquid washed TLE as illustrated in FIG. 1B. In this variation the plenum chamber 18 for the wash liquid is formed between (a) the top steam outlet header pipes 120 which are welded together at 122 where they meet to make a pressure-tight zone and (b) a distributor plate 12 for the wash oil which fits tightly over an extension 16 of the inner tubes and a cylindrical extension 126 of the gas entrance cone. The exit steam pipes serve in lieu of a top tube sheet. Similarly the bottom water inlet header pipes 124 also welded together take the place of the bottom tube sheet. Together the two sets of header pipes form a gas-tight seal against the process gas. Gas flows through the inner tubes 4 and water/steam circulates in the outer tubes 128 of the double pipes. In other respects there is general similarity between this modification and the multitube shell-and-tube arrangement described above, see FIG. 1A.

What is claimed is:

1. In recovering heat from a high temperature cracked hydrocarbon gas, a method of injecting a liquid wash into the tubes of a vertically oriented multitube shell-and-tube transfer line heat exchanger (TLE) comprising more than one heat exchange tube and a top tube sheet to prevent deposition of condensable components and coke which comprises introducing the liquid wash into a plenum chamber adjoining and on top of the shell side of the exchanger and defined by the top tube sheet of the exchanger, a horizontal distributor plate thereabove, an outer wall section of the shell of the exchanger therebetween and the wall portion of the tubes between the top tube sheet and the distributor plate; and causing the liquid wash to overflow the plenum chamber through holes in the distributor plate and flow downwardly within the tubes with the cracked gas.

2. In recovering heat from a high temperture cracked hydrocarbon gas, a method of injecting a liquid wash into the tubes of a vertically oriented multitube double pipe transfer line heat exchanger (TLE) comprising more than one double pipe heat exchange tube and top steam outlet header pipes to prevent deposition of condensable components and coke which comprises introducing the liquid wash into a plenum chamber located adjoining and on top of the top steam outlet header pipes and defined by said top steam outlet header pipes, a horizontal distributor plate thereabove, an outer wall section therebetween and the wall portion of the tubes between the top steam outlet header pipes and the distrubutor plate; and causing the liquid wash to overflow the plenum chamber through holes in the distributor plate and flow downwardly within the tubes with the cracked gas.

3. The method according to claim 1 in which the holes in the distributor plate are arranged in a symmetrical pattern around the tubes.

4. The method according to claim 1 in which the liquid wash and cooled cracked gas exiting from the TLE are introduced into a liquid separator and the liquid bottoms fraction obtained is removed and passed to the TLE as the liquid wash.

5. The method according to claim 4 in which the viscosity of the liquid wash is adjusted by introducing a minor amount of a stream containing lighter constituents.

6. The method according to claim 5 in which the cracked gas obtained from said separator is fractionated and said stream is a heavy gas oil or a tar bottoms from the fractionation.

7. The method according to claim 4 in which the liquid wash is introduced into the plenum chamber of the TLE at a temperature in the range of about 400° to 650° F.

8. The method according to claim 1 or 2 in which the liquid washed TLE is used as a secondary TLE after the cracked gas has been cooled in a primary TLE to a temperature within the range of about 600° to 1300° F. and different pressures of steam are generated by the respective TLE's.

9. The method according to claim 1 or 2 in which the liquid washed TLE is used as a secondary TLE to generate steam after a steam superheating primary TLE has partially cooled the cracked gas while superheating said generated steam and only one pressure of steam is generated.

10. The method according to claim 9 in which said steam supreheating primary TLE cools the cracked gas to a temperature in the range of about 1100° to 1300° F.

11. The method according to claim 9 in which the steam superheating primary TLE comprises in-line double pipe heat exchangers which can be close coupled to the furnace outlets.

* * * * *